United States Patent [19]

Scherbaum et al.

[11] 4,185,968

[45] Jan. 29, 1980

[54] METHOD FOR GENERATING A SOLDERABLE SURFACE ON A CONTACT PIECE OF SILVER AND FINELY DISTRIBUTED GRAPHITE PARTICLES

[75] Inventors: Rudolf Scherbaum, Regensburg; Bernhard Rothkegel; Horst Schreiner, both of Nüremberg, all of Fed. Rep. of Germany

[73] Assignee: Siemens Aktiengesellschaft, Munich, Fed. Rep. of Germany

[21] Appl. No.: 821,343

[22] Filed: Aug. 3, 1977

[30] Foreign Application Priority Data

Aug. 10, 1976 [DE] Fed. Rep. of Germany ..... 2635928

[51] Int. Cl.[2] ..... B08B 7/00

[52] U.S. Cl. ..... 51/316; 51/317; 134/25 R; 134/7; 134/39

[58] Field of Search ..... 134/7, 25, 34, 39; 51/316, 317, 320, 321

[56] References Cited

U.S. PATENT DOCUMENTS

| | | | |
|---|---|---|---|
| 3,427,763 | 2/1969 | Maasberg et al. | 51/321 |
| 3,436,873 | 4/1969 | Biebel | 51/316 |

OTHER PUBLICATIONS

*Product Finishing*, "Barrel Finishing", Jul. 1952, pp. 62–66, 69.

*Primary Examiner*—Marc L. Caroff
*Attorney, Agent, or Firm*—Kenyon & Kenyon

[57] ABSTRACT

In order to generate a graphite free, solderable surface on a contact piece for electric contacts, which consists of silver with graphite particles up to about 5% by weight finely and uniformly distributed therein, the contact piece is subjected to a wet scouring treatment, simultanouesly using scouring stones.

7 Claims, No Drawings

METHOD FOR GENERATING A SOLDERABLE SURFACE ON A CONTACT PIECE OF SILVER AND FINELY DISTRIBUTED GRAPHITE PARTICLES

BACKGROUND OF THE INVENTION

This invention relates to electric contact pieces in general and more particularly to a method for generating a graphite free, solderable surface on a shaped part for electric contacts, which part consists of silver and graphite particles up to 5% by weight finely and uniformly distributed therein.

Shaped parts of electric contact pieces are preferably made of silver, since this metal has a high electric and thermal conductivity. In contacts which are closed accompanied by chattering and arc formation, however, the contact pieces tend to get welded together, so that these contact pieces can then be separated from each other only by the exertion of force (the so-called welding force). One therefore often prefers shaped parts in which graphite particles are finely and uniformly distributed. Such shaped parts have the additional advantage that only a small contact resistance occurs at the contact surface of the shaped parts. Methods for producing such shaped parts of a composite, silver and graphite containing material are known in powder metallurgy.

However, it is a consequence of this reduced tendency to weld that shaped parts of this composite material cannot be joined to support metals, for instance, current leads, without difficulty. Thus, melted solder does not wet the graphite containing silver surface, so that silver soldering is not possible even if the usual fluxes are employed.

So as to make a reliable joint with the support metal possible in spite of this, the shaped parts are made as two layer pieces with a solderable layer. The second layer may, for instance, be pure silver or a silver alloy. In the case of very thin shaped parts, however, the overall thickness of the part is increased thereby. Thus, for a shaped part, for instance, the thickness of which is between 0.5 and 1 mm, the solderable layer must be between 0.2 and 0.3 mm for tolerance reasons and therefore already occupies a considerable part of the volume of the entire shaped part.

In another known method, the graphite particles are burned out by a heat treatment in an oxidizing atmosphere in that area of the finished shaped part which is later to serve as the soldering surface. Thereby, a graphite free layer is now produced in the originally single layer shaped part, the thickness of which is subject to large fluctuations when manufactured in the usual production furnaces. Thus only a tolerance of $\pm 0.04$ mm was obtained under conditions which were set for a burned out layer of 0.05 mm. This layer thickness must be chosen at least so thick, however, so that the melted solder penetrates sufficiently into the soldering surface during the soldering and a durable joint is obtained. This method can therefore likewise be used only for thicker shaped parts.

SUMMARY OF THE INVENTION

It is an object of the present invention to produce a solderable surface in a shaped part for electric contacts, which consists of silver as the base metal and of graphite particles up to about 5% by weight, which are finely and uniformly distributed in the silver, wherein a minimum thickness of the shaped part is not to be already predetermined by the preparation of the soldering surface.

This problem is solved by subjecting the shaped part to a wet scouring treatment, simultaneously using scouring stones.

The wet scouring treatment can be performed, for instance, in a rotating drum which is charged with the finished shaped parts which are produced by powder metallurgical methods, e.g., by sintering and pressing; with commercially available scouring stones, which may also consist of plastic; and a liquid. When the drum rotates, the graphite particles located at the surface of the shaped parts are mechanically torn out by the rubbing on each other and on the scouring stones. At the same time, the relatively soft silver is smeared over the surface. The washed out graphite particles are taken up by the liquid and are flushed away. Since there is generally a liquid film between the scoured surfaces, the graphite particles are washed out of the surface of the shaped parts thoroughly and suspended in the liquid, and a smearing of the graphite over the silver surface does not come about.

Since the action of the liquid in this method consists only of washing out and flusing away the graphite particles, very different liquids such as alcohols, kerosene, gasoline, carbon trichloride etc. can be used. Carbon tetrachloride is particularly well suited as it has about the same density as graphite, so that the graphite particles float in the volume of liquid. Less suited are liquids like oils, which can form residues at the scoured surface which would reduce the wettability of the surface for soldering. If such liquids are used, then the scoured shaped parts would also have to be washed with a solvent and freed of the residues.

As a rule, water is a cheap and well suited liquid for the wet scouring treatment. It may be advantageous to add a wetting agent, e.g., a detergent, which improves the washing out and suspending of the graphite particles to the water.

The surface of graphite containing silver parts has a grey color and grey lines are produced when the surface is rubbed on paper. After the scouring treatment, however, the shaped parts according to the present invention exhibit a bright silver surface, on which graphite occlusions can no longer be observed. A polished section shows that the graphite particles are washed out only from the surface and the voids produced are partially smeared over with silver.

The method according to the present invention is particularly well suited for applying a soldering surface to single layer shaped parts. The finished shaped part including the soldering surface than exhibits a substantially single layer structure, as a defined measurable thickness of the silver smeared over the surface can scarcely be identified in a polished section under a light microscope. At those points of the surface where silver grains were already located, the "layer thickness" of the soldering surface is determined by the size of the silver bodies. At the other points, at which originally graphite particles were located, the voids created by the washing out process are filled with silver to a depth that varies greatly and is on the average usually between 0.5 and 10 $\mu$m. In any event, graphite enclosures are found again in the underlying layer.

The depth of the graphite free surface is largely independent of the duration of the wet scouring treatment.

For, once the graphite particles located at the surface are washed out and the voids produced smeared over with silver, only silver is removed by further scouring until new graphite particles located at greater depth are exposed without an increase of the "thickness" of the graphite free surface.

In the wet scouring process in a drum, as mentioned, the entire shape part is coated with a graphite free surface, i.e., not only the area provided for soldering but also the contact surface, at which the graphite particles are definitely desired for reducing the welding force when larger currents (more than 10 A) are switched. However, this is not a disadvantage, since a silver layer which is less than 20 μm is already destroyed in the arc the first time that such currents are switched. Then, the intended effect of the graphite particles goes into action again. To the contrary, the fact that the surface of the shaped parts is uniformly solderable everywhere, brings about a simplification of the soldering process, as it is no longer necessary in the case of flat shaped parts to differentiate between a soldering surface and a contact surface. It is a further advantage of the method that the shaped parts can be deburred during the wet scouring treatment at the same time.

Surprisingly, the surface generated can be wetted easily during the soldering and results in a durable joint, although there is no graphite free layer that is thicker than 10 μm.

In the scouring of graphite containing silver parts, the graphite is as a rule smeared over the surface, which further makes the wetting with melted solder harder. Thus, the rule has been applied heretofore, for instance, for graphite containing shaped silver parts on which a second, solderable layer is applied, not to scour the finished shaped parts any more so as not to degrade the solderability of the second layer by the smearing over of graphite. It is therefore surprising that, through a wet scouring treatment, a surface is generated, on which no graphite is smeared and which is suitable as a soldering surface.

DETAILED DESCRIPTION OF THE INVENTION

Single layer shaped parts of silver and 3% by weight graphite with a size 5×5×0.7 mm were made by powder metallurgy. The steel drum of 8 l volume of a table top scouring equipment was charged with 3 kg of these shaped parts, 2 kg of tetrahedral scouring stones with sides 4 mm long, and 2 l water, to which 20 g of a commercially available aluminum treatment agent were added, which promotes the removal. The drum treatment was carried on for a scouring time of 60 min at a speed of 64 r.p.m. After the scouring treatment, the shaped parts were screened off, washed and dried.

The shaped parts so produced could be silver soldered on copper supports with conventional solders and fluxes, e.g., cadmium containing silver solder (40% by weight Ag) and borax containing fluxing agent. Also, soldering without flux, using phosphorus containing silver hard solder, on copper is possible with perfect results. In addition, the method for manufacturing the contact pieces according to the invention is inexpensive.

For testing, the shaped parts made in this manner were placed in small automatic circuit breakers, the nominal currents being 10 to 63 A and the short-circuit currents up to 2000 A.

What is claimed is:

1. A method for generating a graphite free solderable surface on a shaped part for electrical contacts which part consists of silver as a base metal and which part includes graphite particles, the graphite paticles not amounting to more than 5% by weight of said part and being finely and uniformly distributed therein, comprising sufficiently scouring the shaped part by simultaneously contacting said part with a liquid and scouring stones to produce a graphite free solderable surface on the shaped part.

2. The method according to claim 1, wherein said scouring is carried out using water as said liquid, to which a wetting agent is added.

3. A method for generating a graphite free solderable surface on a shaped part for electrical contacts which part consists of silver as a base metal and which includes graphite particles, the graphite particles not amounting to more than 5% by weight of said part and being finely and uniformly distributed therein, comprising disposing a plurality of said shaped parts of silver containing graphite in a sealed drum of table top scouring equipment; also disposing in said drum a plurality of scouring stones; adding to the drum a liquid; and then rotating said drum to carry out sufficient scouring to generate a graphite free solderable surface on said parts.

4. The method of claim 3 wherein said liquid is water and wherein three parts by weight of the shaped parts, two parts by weight of scouring stones and two parts by weight of water are placed in said drum.

5. The method according to claim 4 wherein said scouring stones have a tetrahedral shape having side approximately 4 millimeters long.

6. The method according to claim 3 wherein said step of rotating is carried out for approximately one hour at the speed of approximately 64 rpm.

7. The method according to claim 3 and further including the steps of screening off the shaped parts, washing the shaped parts and drying the shaped parts.

* * * * *